US008308320B2

(12) United States Patent
Tickner et al.

(10) Patent No.: US 8,308,320 B2
(45) Date of Patent: Nov. 13, 2012

(54) LIGHT EMITTING DIODE MODULES WITH MALE/FEMALE FEATURES FOR END-TO-END COUPLING

(75) Inventors: Jerold Alan Tickner, Newnan, GA (US); Chun Wah Chan, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 316 days.

(21) Appl. No.: 12/617,127

(22) Filed: Nov. 12, 2009

(65) Prior Publication Data

US 2011/0110085 A1 May 12, 2011

(51) Int. Cl.
*F21S 4/00* (2006.01)
*F21V 21/005* (2006.01)

(52) U.S. Cl. ..... 362/249.06; 362/249.02; 362/219; 362/217.17; 362/545

(58) Field of Classification Search ..... 362/612, 362/545, 97.3, 249.02, 249.06, 219, 217.17
See application file for complete search history.

(56) References Cited

U.S. PATENT DOCUMENTS 3,038,139 A 6/1962 Bonanno
3,706,882 A 12/1972 Eby
3,810,258 A 5/1974 Mathauser
4,302,800 A * 11/1981 Pelletier ..... 362/249.11
4,538,214 A 8/1985 Fisher et al.
4,617,612 A 10/1986 Pritchett
4,667,277 A * 5/1987 Hanchar ..... 362/249.01
4,719,549 A 1/1988 Apel
4,752,756 A 6/1988 Bartel
4,959,761 A 9/1990 Critelli et al.
5,154,509 A 10/1992 Wulfman et al.
5,161,882 A * 11/1992 Garrett ..... 362/249.01
5,291,039 A 3/1994 Ogata et al.
5,342,204 A 8/1994 Och
5,397,238 A 3/1995 Och
5,397,239 A 3/1995 Zaderej et al.
5,418,384 A 5/1995 Yamana et al.
5,559,681 A * 9/1996 Duarte ..... 362/231
5,660,461 A * 8/1997 Ignatius et al. ..... 362/241
6,050,044 A * 4/2000 McIntosh ..... 52/591.1
6,176,760 B1 * 1/2001 Ngai ..... 446/444
6,233,971 B1 5/2001 Ohlund
6,320,182 B1 11/2001 Hubble et al.
6,343,942 B1 2/2002 Okamoto
6,357,904 B1 3/2002 Kawashima
6,361,186 B1 3/2002 Slayden
6,367,948 B2 4/2002 Branson
6,422,716 B2 7/2002 Henrici et al.
6,426,807 B1 7/2002 Kawai et al.
6,509,840 B2 1/2003 Martineau
6,540,372 B2 4/2003 Joseph
6,561,690 B2 5/2003 Balestriero et al.
6,582,100 B1 6/2003 Hochstein et al.
6,585,393 B1 7/2003 Brandes
6,592,238 B2 7/2003 Cleaver et al.
6,601,970 B2 8/2003 Ueda et al.
(Continued)

*Primary Examiner* — Ismael Negron
(74) *Attorney, Agent, or Firm* — King & Spalding LLP

(57) ABSTRACT

A light fixture includes multiple LED modules, with each LED module including a substrate on which one or more LED's are disposed. The LED modules can interface with one another in a variety of different configurations such that when adjacent LED modules interface with one another, there is a substantially continuous array of LED's across the LED modules. Electrical connectors or other means for powering the LED modules are disposed such that they do not impact the continuity of light across adjacent LED modules.

19 Claims, 7 Drawing Sheets

U.S. PATENT DOCUMENTS 6,612,717 B2 * 9/2003 Yen ..... 362/245
6,641,284 B2 11/2003 Stopa et al.
6,641,294 B2 * 11/2003 Lefebvre ..... 362/544
6,659,622 B2 12/2003 Katogi et al.
6,676,284 B1 1/2004 Wilson
6,761,472 B1 7/2004 Cleaver
6,767,111 B1 7/2004 Lai
6,776,504 B2 8/2004 Sloan et al.
6,802,626 B2 10/2004 Belfer et al.
6,882,111 B2 * 4/2005 Kan et al. ..... 362/217.12
6,932,495 B2 * 8/2005 Sloan et al. ..... 362/294
6,940,659 B2 9/2005 McLean et al.
7,063,440 B2 6/2006 Mohacsi et al.
7,066,739 B2 6/2006 McLeish
7,070,418 B1 7/2006 Wang
7,101,056 B2 9/2006 Pare
7,137,727 B2 11/2006 Joseph et al.
7,159,997 B2 1/2007 Reo et al.
7,161,189 B2 1/2007 Wu
7,163,404 B2 1/2007 Linssen et al.
7,201,511 B2 4/2007 Moriyama et al.
7,213,941 B2 5/2007 Sloan et al.
7,241,031 B2 7/2007 Sloan et al.
7,273,299 B2 9/2007 Parkyn et al.
7,290,913 B2 11/2007 Watanabe et al.
7,322,718 B2 1/2008 Setomoto et al.
7,322,828 B1 1/2008 Chiang
7,322,873 B2 * 1/2008 Rosen et al. ..... 446/91
7,348,604 B2 3/2008 Matheson
7,350,937 B2 * 4/2008 Yamamoto et al. ..... 362/249.01
7,377,669 B2 * 5/2008 Farmer et al. ..... 362/249.01
7,384,170 B2 6/2008 Skegin
7,401,946 B2 * 7/2008 Laukhuf ..... 362/270
7,470,055 B2 12/2008 Hacker et al.
7,478,920 B2 1/2009 Nanbu
7,506,995 B2 3/2009 Thomas et al.
7,538,356 B2 5/2009 Lai
7,549,779 B2 6/2009 Genenbacher
7,572,027 B2 8/2009 Zampini et al.
7,625,104 B2 12/2009 Zhang et al.
7,677,914 B2 3/2010 Nall et al.
7,703,941 B2 * 4/2010 Lee ..... 362/219
7,726,840 B2 * 6/2010 Pearson et al. ..... 362/249.06
7,726,974 B2 6/2010 Shah et al.
7,731,558 B2 * 6/2010 Capriola ..... 446/91
7,789,529 B2 9/2010 Roberts et al.
7,791,089 B2 9/2010 Bisberg
7,806,569 B2 10/2010 Sanroma et al.
7,806,574 B2 10/2010 Van Laanen et al.
7,815,341 B2 10/2010 Steedly et al.
7,857,482 B2 12/2010 Reo et al.
8,052,299 B2 * 11/2011 Lin ..... 362/219
2002/0093832 A1 7/2002 Hamilton
2003/0048641 A1 3/2003 Alexanderson et al.
2003/0081419 A1 5/2003 Jacob
2003/0174517 A1 9/2003 Kiraly
2003/0223235 A1 12/2003 Mohacsi et al.
2004/0076004 A1 4/2004 Smith
2004/0114355 A1 6/2004 Rizken et al.
2004/0161213 A1 8/2004 Lee
2004/0201980 A1 10/2004 Fischer et al.
2005/0146899 A1 7/2005 Joseph et al.
2005/0157500 A1 7/2005 Chen et al.
2005/0162265 A1 7/2005 Werner et al.
2005/0264473 A1 12/2005 Sibbett
2006/0093308 A1 5/2006 Ryan
2006/0146531 A1 7/2006 Reo et al.
2006/0262533 A1 11/2006 Lin et al.
2007/0147030 A1 6/2007 Lee et al.
2007/0190845 A1 8/2007 Mrakovich et al.
2008/0030981 A1 * 2/2008 Mrakovich et al. ..... 362/219
2008/0094828 A1 * 4/2008 Shao ..... 362/219
2008/0158878 A1 7/2008 Van Laanen et al.
2008/0170367 A1 7/2008 Lai
2008/0244944 A1 10/2008 Nall et al.
2008/0298058 A1 12/2008 Kan et al.
2009/0021936 A1 1/2009 Stimac et al.
2009/0073693 A1 3/2009 Nall et al.
2009/0101921 A1 4/2009 Lai
2009/0161371 A1 6/2009 Vukosic et al.
2009/0224265 A1 9/2009 Wang et al.
2009/0237011 A1 9/2009 Shah et al.
2009/0238252 A1 9/2009 Shah et al.
2009/0240380 A1 9/2009 Shah et al.
2009/0279298 A1 11/2009 Mier-Langner et al.
2009/0290348 A1 11/2009 Van Laanen et al.
2009/0303712 A1 12/2009 Wung et al.
2009/0310335 A1 12/2009 Park
2010/0002450 A1 1/2010 Pachler et al.
2010/0053956 A1 3/2010 Park et al.
2010/0073931 A1 3/2010 Watanabe
2010/0103672 A1 4/2010 Thomas et al.
2010/0103687 A1 4/2010 Pitlor
2010/0110680 A1 5/2010 Bianco et al.
2010/0118532 A1 5/2010 Liang et al.
2010/0124067 A1 5/2010 Hente et al.
2010/0135022 A1 6/2010 Deguara
2010/0164409 A1 7/2010 Lo et al.
2010/0182782 A1 7/2010 Ladewig
2010/0182788 A1 7/2010 Luo et al.
2010/0188846 A1 7/2010 Oda et al.
2010/0195322 A1 8/2010 Kawakami et al.
2010/0201269 A1 8/2010 Tzou et al.
2010/0214747 A1 8/2010 Jacobs et al.
2010/0214779 A1 * 8/2010 Kao ..... 362/249.02
2010/0220479 A1 * 9/2010 Yamashita et al. ..... 362/249.02
2010/0226125 A1 9/2010 Liao et al.
2010/0232154 A1 9/2010 Chen
2010/0254134 A1 * 10/2010 McCanless ..... 362/235
2010/0271804 A1 10/2010 Levine
2010/0271834 A1 10/2010 Muessli
2010/0277098 A1 11/2010 Sarna
2010/0277666 A1 11/2010 Bertram et al.
2010/0277913 A1 11/2010 Ward
2010/0308350 A1 12/2010 Bisberg
2011/0013377 A1 * 1/2011 Kim ..... 362/97.1
2011/0019417 A1 1/2011 Van Laanen et al.

* cited by examiner

LIGHT EMITTING DIODE MODULES WITH MALE/FEMALE FEATURES FOR END-TO-END COUPLING

TECHNICAL FIELD

The invention relates generally to light emitting diodes ("LED's") and more particularly to LED modules that interface with one another in a variety of different configurations to provide a substantially continuous array of LED's across the LED modules.

BACKGROUND

The use of LED's in place of conventional incandescent, fluorescent, and neon lamps has a number of advantages. LED's tend to be less expensive and longer lasting than conventional incandescent, fluorescent, and neon lamps. In addition, LED's generally can output more light per watt of electricity than incandescent, fluorescent, and neon lamps.

Linear light fixtures are popular for a variety of different residential and commercial lighting applications, including cabinet lighting, shelf lighting, cove lighting, and signage. Cove lighting is a form of indirect lighting in which lamps are built into ledges, recesses, or valences in a ceiling or high on the walls of a room. Linear light fixtures can provide primary lighting in an environment or serve as aesthetic accents or designs that complement other lighting sources.

Conventional linear LED light fixtures include modules or strips of LED's that are mechanically and electrically coupled to one another in an end-to-end relationship. FIG. 1 illustrates two conventional LED strips 105 and 106 that could be used in such a light fixture. Each strip 105, 106 includes multiple LED's 108. A second end 105*b* of strip 105 is electrically and mechanically coupled to a first end 106*a* of strip 106 via a connector 110. Adjacent pairs of LED's 108*a*-108*d* on strip 105 are spaced apart from one another by a distance X. Adjacent pairs of LED's 108*e*-108*h* on strip 106 are spaced apart from one another by the same distance X.

Adjacent LED's 108*d* and 108*e* across the LED strips 105 and 106 are spaced apart from one another by a distance Y. The distance Y is significantly larger than the distance X. This space between the LED's 108*d* and 108*e* causes the light output by the LED strips 105 and 106 to be discontinuous. In particular, the light output by the LED strips 105 and 106 includes an undesirable break or shadow that corresponds to the space between the LED strips 105 and 106.

Therefore, a need exists in the art for an improved linear LED light fixture. In particular, a need exists in the art for LED modules that interface with one another in a way that produces continuous light output across the LED modules. A further need exists in the art for such light output to be devoid of undesirable shadows and breaks.

SUMMARY

The invention provides an improved linear LED light fixture. In particular, the invention provides LED modules that interface with one another in a variety of different configurations to provide a substantially continuous array of LED's across the LED modules. This continuity in the array of the LED's enables the LED modules to output continuous light across the LED modules, without any undesirable shadows or breaks.

Each LED module includes a substrate on which one or more LED's are disposed. The LED modules can interface with one another in a substantially continuous, end-to-end relationship. For example, each substrate can include a notch or protrusion in which a corresponding protrusion or notch of an adjacent substrate may be disposed. When adjacent LED modules interface with one another, there is a substantially continuous array of LED's across the LED modules. For example, one or more rows or patterns of LED's may continue, substantially uninterrupted, within and across the LED modules.

The LED modules may be powered using electrical connectors, which electrically couple together adjacent LED modules. Each electrical connector can be coupled to its associated LED modules at locations other than the ends at which the LED modules interface with one another. Thus, unlike with the conventional LED strips 105 and 106 depicted in FIG. 1, the electrical connectors do not impact the continuity of light across adjacent LED modules. In addition to, or instead of, electrical connectors, powered surfaces, such as rails and tracks, may power the LED modules. For example, the LED modules may be coupled to the powered surfaces.

A light fixture may include multiple LED modules mounted to a surface. For example, the LED modules may be removably coupled to the surface using screws, nails, or other fastening devices. The light fixture may be a linear or non-linear light fixture used in residential, commercial, or other lighting applications.

These and other aspects, features and embodiments of the invention will become apparent to a person of ordinary skill in the art upon consideration of the following detailed description of illustrated embodiments exemplifying the best mode for carrying out the invention as presently perceived.

BRIEF DESCRIPTION OF THE DRAWINGS

For a more complete understanding of the present invention and the advantages thereof, reference is now made to the following description, in conjunction with the accompanying figures briefly described as follows.

DETAILED DESCRIPTION OF EXEMPLARY EMBODIMENTS

The invention is directed to LED modules that interface with one another in a variety of different configurations to provide a substantially continuous array of LED's across the LED modules. This continuity in the array of the LED's enables the LED modules to output continuous light across the LED modules, without any undesirable shadows or breaks. The LED modules can provide light in any of a number of different residential and commercial lighting applications. For example, the LED modules can be installed on any surface to provide cabinet lighting, shelf lighting, cove lighting, and signage.

Figure 1:
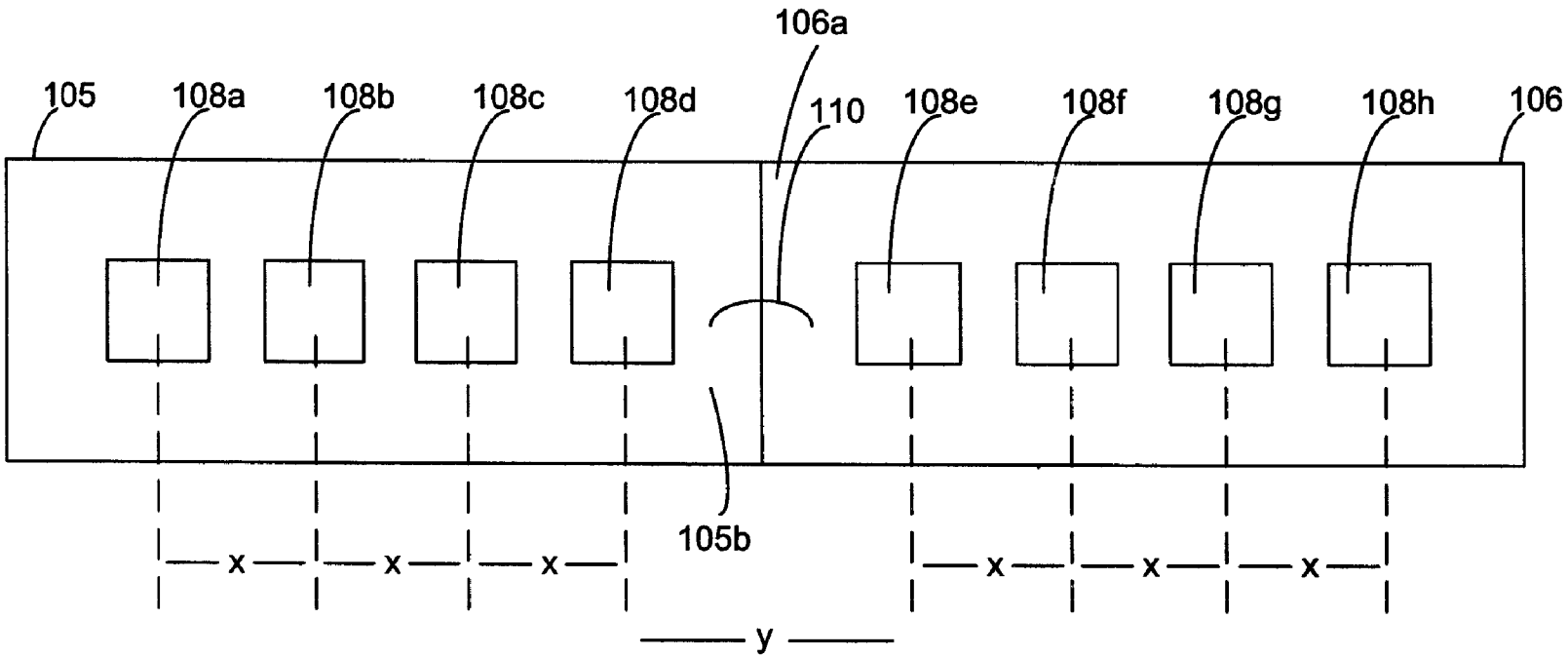
Fig. 1 (Prior Art)
FIG. 1 is a block diagram that illustrates conventional LED strips of a linear light fixture.
Figure 2:
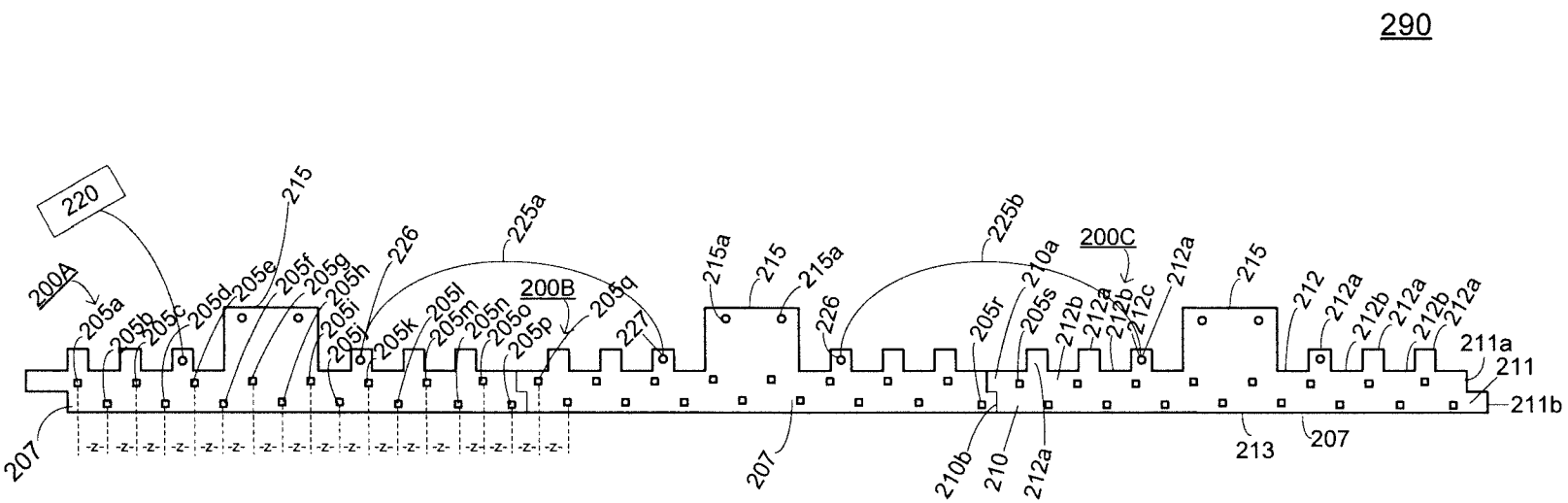
FIG. 2 is a top elevational view of an LED assembly, which includes linear LED modules, in accordance with certain exemplary embodiments.
Figure 3:
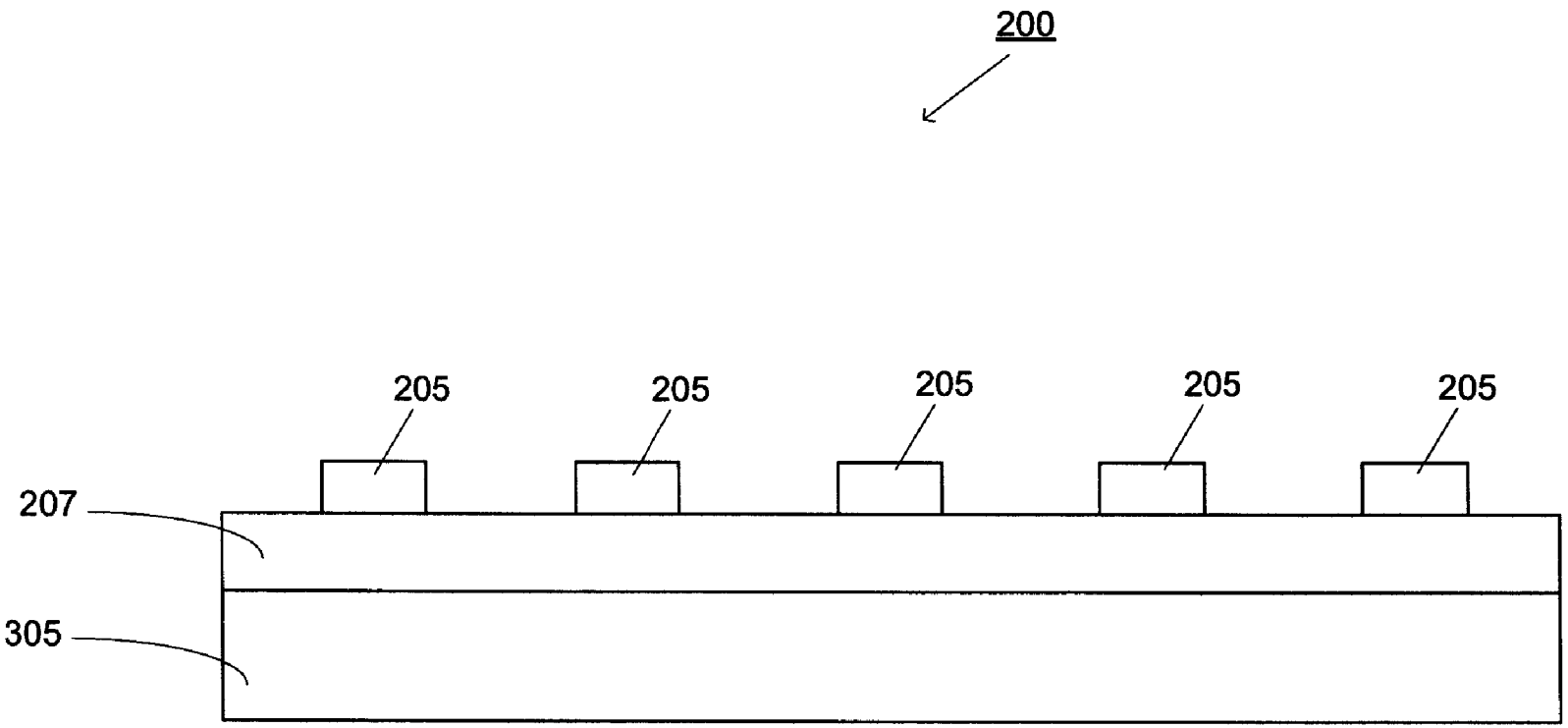
FIG. 3 is a side elevational view of one of the linear LED modules depicted in FIG. 2, in accordance with certain exemplary embodiments.

Turning now to the drawings, in which like numerals indicate like elements throughout the figures, exemplary embodiments of the invention are described in detail. FIG. 2 is a top elevational view of an LED assembly 290, which includes LED modules 200, in accordance with certain exemplary embodiments. FIG. 3 is a side elevational view of one of the LED modules 200, in accordance with certain exemplary embodiments. With reference to FIGS. 2 and 3, each LED module 200 is configured to create artificial light or illumination via multiple LED's 205. For purposes of this application, each LED 205 may be a single LED die or may be an LED package having one or more LED dies on the package. In certain exemplary embodiments, the number of dies on each LED package ranges from 1-312. For example, each LED package may include 2 dies.

Each LED module 200 includes at least one substrate 207 to which the LED's 205 are coupled. Each substrate 207 includes one or more sheets of ceramic, metal, laminate, circuit board, flame retardant (FR) board, mylar, or other material. Although depicted in FIGS. 2 and 3 as having a substantially rectangular shape, a person of ordinary skill in the art having the benefit of the present disclosure will recognize that the substrate 207 can have any linear or non-linear shape. Each LED 205 is attached to its respective substrate 207 by a solder joint, a plug, an epoxy or bonding line, or other suitable provision for mounting an electrical/optical device on a surface. Each LED 205 includes semi-conductive material that is treated to create a positive-negative (p-n) junction. When the LED's 205 are electrically coupled to a power source 220, such as a driver, current flows from the positive side to the negative side of each junction, causing charge carriers to release energy in the form of incoherent light.

The wavelength or color of the emitted light depends on the materials used to make each LED 205. For example, a blue or ultraviolet LED typically includes gallium nitride (GaN) or indium gallium nitride (InGaN), a red LED typically includes aluminum gallium arsenide (AlGaAs), and a green LED typically includes aluminum gallium phosphide (AlGaP). Each of the LED's 205 is capable of being configured to produce the same or a distinct color of light. In certain exemplary embodiments, the LED's 205 include one or more white LED's and one or more non-white LED's, such as red, yellow, amber, green, or blue LED's, for adjusting the color temperature output of the light emitted from the LED modules 200. A yellow or multi-chromatic phosphor may coat or otherwise be used in a blue or ultraviolet LED 205 to create blue and red-shifted light that essentially matches blackbody radiation. The emitted light approximates or emulates "white," light to a human observer. In certain exemplary embodiments, the emitted light includes substantially white light that seems slightly blue, green, red, yellow, orange, or some other color or tint. In certain exemplary embodiments, the light emitted from the LED's 205 has a color temperature between 2500 and 6000 degrees Kelvin.

In certain exemplary embodiments, an optically transmissive or clear material (not shown) encapsulates at least some of the LED's 205, either individually or collectively. This encapsulating material provides environmental protection while transmitting light from the LED's 205. For example, the encapsulating material can include a conformal coating, a silicone gel, a cured/curable polymer, an adhesive, or some other material known to a person of ordinary skill in the art having the benefit of the present disclosure. In certain exemplary embodiments, phosphors are coated onto or dispersed in the encapsulating material for creating white light.

Each LED module 200 includes one or more rows of LED's 205. The term "row" is used herein to refer to an arrangement or a configuration whereby one or more LED's 205 are disposed approximately in or along a line. LED's 205 in a row are not necessarily in perfect alignment with one another. For example, one or more LED's 205 in a row might be slightly out of perfect alignment due to manufacturing tolerances or assembly deviations. In addition, LED's 205 in a row might be purposely staggered in a non-linear or non-continuous arrangement. Each row extends along a longitudinal axis of the LED module 200.

Although depicted in FIG. 2 as having two staggered rows of LED's 205, a person of ordinary skill in the art having the benefit of the present disclosure will recognize that the LED's 205 can be arranged in any number of different rows, shapes, and configurations without departing from the spirit and scope of the invention. For example, the LED's 205 can be arranged in four different rows, with each row comprising LED's 205 of a different color. In certain exemplary embodiments, each row and/or each LED 205 is separately controlled by the driver so that each row can independently be turned on and off or otherwise reconfigured.

In the exemplary embodiment depicted in FIG. 2, each LED module 200 includes 16 LED's 205. The number of LED's 205 on each LED module 200 may vary depending on the size of the LED module 200, the size of the LED's 205, the amount of illumination required from the LED module 200, and/or other factors. For example, a larger LED module 200 with small LED's 205 may include more LED's 205 than a smaller LED module 200 with large LED's 205.

Adjacent pairs of LED's 205 on each LED module 200 are spaced apart from one another by a distance Z. Adjacent LED's 205*p* and 205*q* across LED modules 200A and 200B are spaced apart from one another by the same or substantially the same distance Z. Similarly, adjacent LED's 205*r* and 205*s* across LED modules 200B and 200C are spaced apart from one another by the same or substantially the same distance Z. Thus, all adjacent pairs of LED's 205 across the LED modules 200 are spaced apart by the same or substantially the same distance Z. This equal or substantially equal spacing across the LED modules 200 provides a continuous array of LED's 205 across the LED modules 200. Because the array is continuous, light output from the LED modules 200 is continuous, without any undesirable breaks or shadows. As described below with reference to FIG. 5, in certain alternative exemplary embodiments, the LED modules 200 can be configured to provide a substantially continuous array of LED's 205 without each adjacent pair of LED's 205 being equally spaced apart.

Ends 210 and 211 of each LED module 200 have profiles that enable adjacent pairs of the LED modules 200 to interface with one another. For example, in the embodiment depicted in FIG. 2, a first side end 210 of each LED module 200 includes a protrusion 210*a* that is sized and configured to be at least partially disposed adjacent a corresponding notch 211*a* in a second side end 211 of an adjacent LED module 200. Similarly, the second side end 211 of each LED module 200 includes a protrusion 211*b* that is sized and configured to be at least partially disposed adjacent a corresponding notch 210*b* in the first side end 210 of an adjacent LED module 200. Although depicted in FIG. 2 as substantially rectangular, the notches 210*b* and 211*a* and protrusions 210*a* and 211*b* in the LED modules 200 can have any size or shape. In addition, although depicted in FIG. 2 in an end-to-end relationship, adjacent LED modules 200 may interface one another in other configurations. For example, LED modules 200B and 200C may be arranged such that the protrusion 210*a* of LED module 200C rests at least partially adjacent the notch 211*a* or protrusion 211*b* of LED module B and a longitudinal axis of LED module 200C is disposed substantially perpendicular to a longitudinal axis of LED module 200B, substantially as described below with reference to FIG. 5.

A person of ordinary skill in the art having the benefit of the present disclosure will recognize that any of a number of other configurations of the adjacent ends 210 and 211 may be used to interface adjacent LED modules 200. For example, in certain alternative exemplary embodiments, the end of one LED module 200 can include multiple protrusions that are sized and configured to be disposed within corresponding notches in an adjacent LED module 200. Alternatively, in certain exemplary embodiments, one or both of the ends of each LED module 200 may have a substantially flat edge with not notches or protrusions. In certain alternative exemplary embodiments, only one of the ends 210 and 211 of each LED module 200 may have a profile that enables the LED module 200 to interface with another LED module 200. In certain exemplary embodiments, a top side end 212 of each LED module 200 includes one or more protrusions 212*a* and notches 212*b* sized and configured to engage one or more of the notches 210*b* and 211*a* and protrusions 210*a* and 211*b* in the side ends 210 and 211 of another, adjacent LED module 200.

In certain exemplary embodiments, adjacent LED modules 200 are electrically coupled to one another via a connector 225*a* or 225*b*. Each connector 225*a*, 225*b* can include one or more electrical wires, plugs, sockets, and/or other components that enable electrical transmission between electrical devices. In these exemplary embodiments, each connector 225*a*, 225*b* includes a first end 226 that is coupled to a protrusion 212*a* in a top side end 212 of one LED module 200 and a second end 227 that is coupled to a protrusion 212*a* in a top side end 212 of an adjacent LED module 200.

Because the connectors 225*a*, 225*b* extend from top side ends 212 of the LED modules 200, and not from interfacing side ends 210 and 211 of the LED modules 200, the LED modules 200 can engage one another without any significant gaps between the LED modules 200 or the pattern of LED's 205 on the LED modules 200. Thus, the LED modules 200 can provide a substantially continuous array or pattern of LED's 205 across the LED modules 200. A person of ordinary skill in the art having the benefit of the present disclosure will recognize that, in alternative exemplary embodiments, each connector 225*a*, 225*b* may be coupled to its corresponding LED modules 200 at other locations. For example, one or more of the connectors 225*a*, 225*b*can be connected to a bottom end 213 of an LED module 200. In certain alternative exemplary embodiments, the LED modules 200 can be mounted to a powered rail, track, or other device, which powers the LED modules 200 without using any connectors 225*a*, 225*b*.

Each LED module 200 is configured to be mounted to a surface (not shown) to illuminate an environment associated with the surface. For example, each LED module 200 may be mounted to, or within, a wall, counter, cabinet, sign, light fixture, or other surface. Each LED module 200 may be mounted to its respective surface using solder, braze, welds, glue, epoxy, rivets, clamps, screws, nails, or other fastening means known to a person of ordinary skill in the art having the benefit of the present disclosure. In certain exemplary embodiments, one or more of the LED modules 200 are removably mounted to their corresponding surfaces to enable efficient repair, replacement, and/or reconfiguration of the LED module(s) 200. For example, each LED module 200 may be removably mounted to its corresponding surface via one or more screws extending through openings 215*a* defined in protrusions 215 in the top side end 212 of the LED module 200.

To remove one of the LED modules 200, a person can simply disconnect the connector(s) 225*a* or 225*b* associated with the LED module 200 and unscrew the screws associated with the LED module 200. In certain exemplary embodiments, once the LED module 200 is removed, the remaining LED modules 200 may be electrically coupled to one another using one or more of the disconnected connectors 225*a* or 225*b*. For example, if a person removes LED module 200B, he can electrically couple LED module 200A to LED module 200C by connecting the connector 225*a* to the LED module 200C in place of the connector 225*b*.

The level of light a typical LED 205 outputs depends, in part, upon the amount of electrical current supplied to the LED 205 and upon the operating temperature of the LED 205. Thus, the intensity of light emitted by an LED 205 changes when electrical current is constant and the LED's 205 temperature varies or when electrical current varies and temperature remains constant, with all other things being equal. Operating temperature also impacts the usable lifetime of most LED's 205.

As a byproduct of converting electricity into light, LED's 205 generate a substantial amount of heat that raises the operating temperature of the LED's 205 if allowed to accumulate on the LED's 205, resulting in efficiency degradation and premature failure. Each LED module 200 is configured to manage heat output by its LED's 205. Specifically, each LED module 200 includes a conductive member 305 that is coupled to the substrate 207 and assists in dissipating heat generated by the LED's 205. Specifically, the member 305 acts as a heat sink for the LED's 205. The member 305 receives heat conducted from the LED's 205 through the substrate 207 and transfers the conducted heat to the surrounding environment (typically air) via convection.

Figure 4:
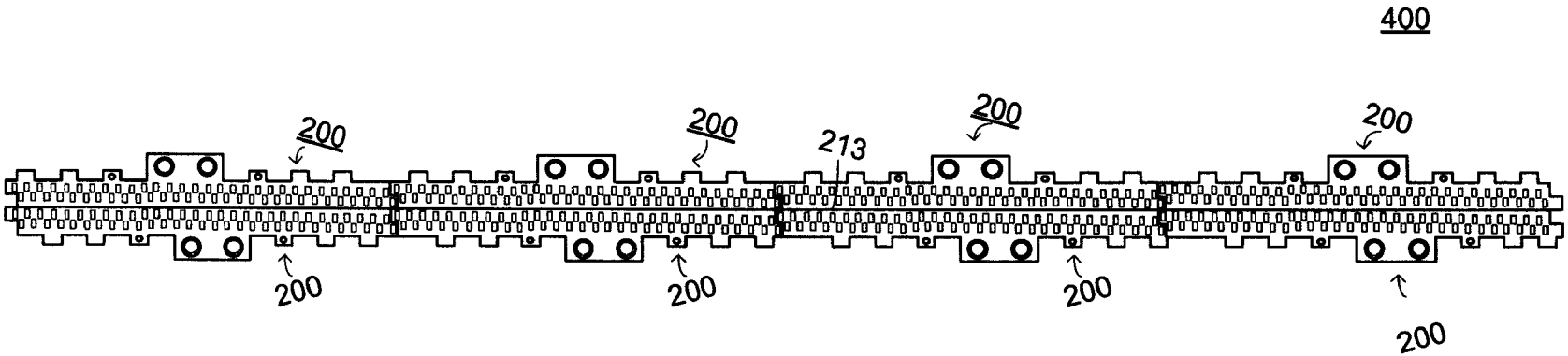
FIG. 4 is a top elevational view of an LED assembly, which includes multiple groupings of the linear LED modules depicted in FIG. 2, in accordance with certain exemplary embodiments.

FIG. 4 is a top elevational view of an LED assembly 400, which includes multiple groupings of the LED modules 200 depicted in FIG. 2, in accordance with certain exemplary embodiments. In addition to the interfaces at the side ends 210 and 211 of the LED modules, interfaces exist at bottom ends 213 of the LED modules 200. Specifically, a bottom end 213 of each LED module 200 engages a bottom end 213 of another, adjacent LED module 200. By interfacing the bottom ends 213, two adjacent LED modules 200 having a particular width can effectively constitute a single, continuous LED source that has a width that is twice the width of a single LED module.

Figure 5:
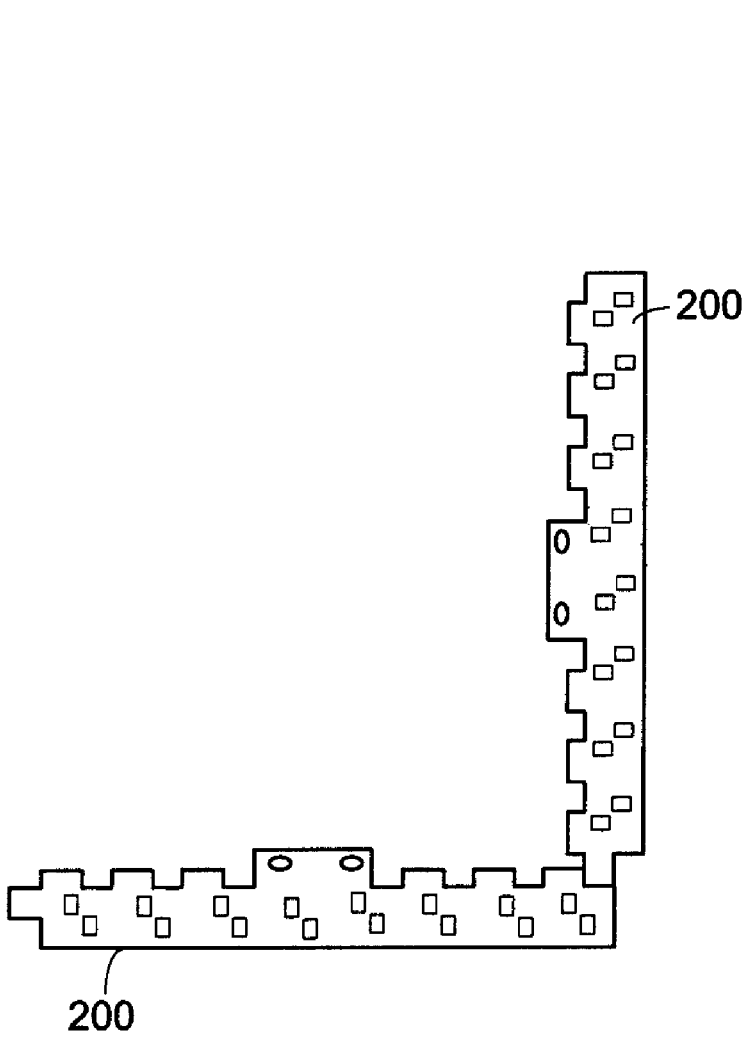
FIG. 5 is a top elevational view of an LED assembly, which includes LED modules arranged in an "L" shape, in accordance with certain exemplary embodiments.

The options for configuring and arranging multiple LED modules 200 with respect to one another are infinite. For example, multiple LED modules 200 can be arranged to form any of a variety of numbers, letters, shapes, etc. For example, FIG. 5 is a top elevational view of an LED assembly 500, which includes LED modules 200 arranged in an "L" shape, in accordance with certain exemplary embodiments. Thus, the LED modules 200 provide a flexible and efficient lighting option for both new lighting application installations and retro-fit applications. For example, in certain exemplary embodiments, LED modules 200 may be arranged on, and secured to, a member to be retro-fit into an existing light fixture.

Figure 6:
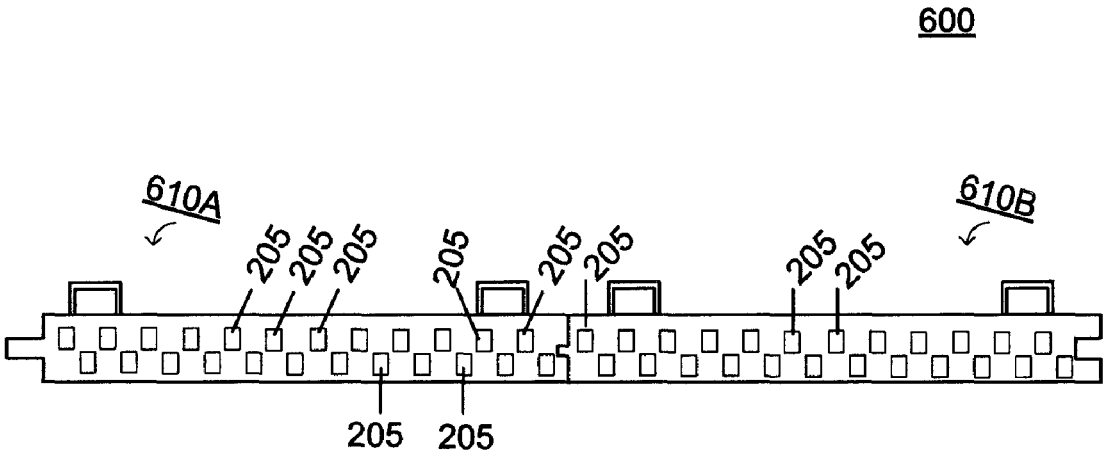
FIG. 6 is a top elevational view of an LED assembly of linear LED modules, in accordance with certain alternative exemplary embodiments.

FIG. 6 is a top elevational view of an LED assembly 600, which includes linear LED modules 610A and 610B, in accordance with certain alternative exemplary embodiments. Like the LED modules 200A-200C depicted in FIG. 2, each of the LED modules 610 includes one or more rows of LED's 205. Unlike the LED's 205 in the LED modules 200A-200C, the LED's 205 in the LED modules 610A and 610B are not equally spaced apart. Instead, the LED's 205 in the LED modules 610A and 610B are arranged in a pattern in which adjacent pairs of LED's 205 have different spacings. In certain exemplary embodiments, the pattern is predictable and repeated on the same LED module 610. In addition, or in the alternative, because the LED modules 610 interface one another without any gaps between the LED modules 610, the pattern may be repeated continuously across adjacent modules 610A and 610B.

Figure 7:
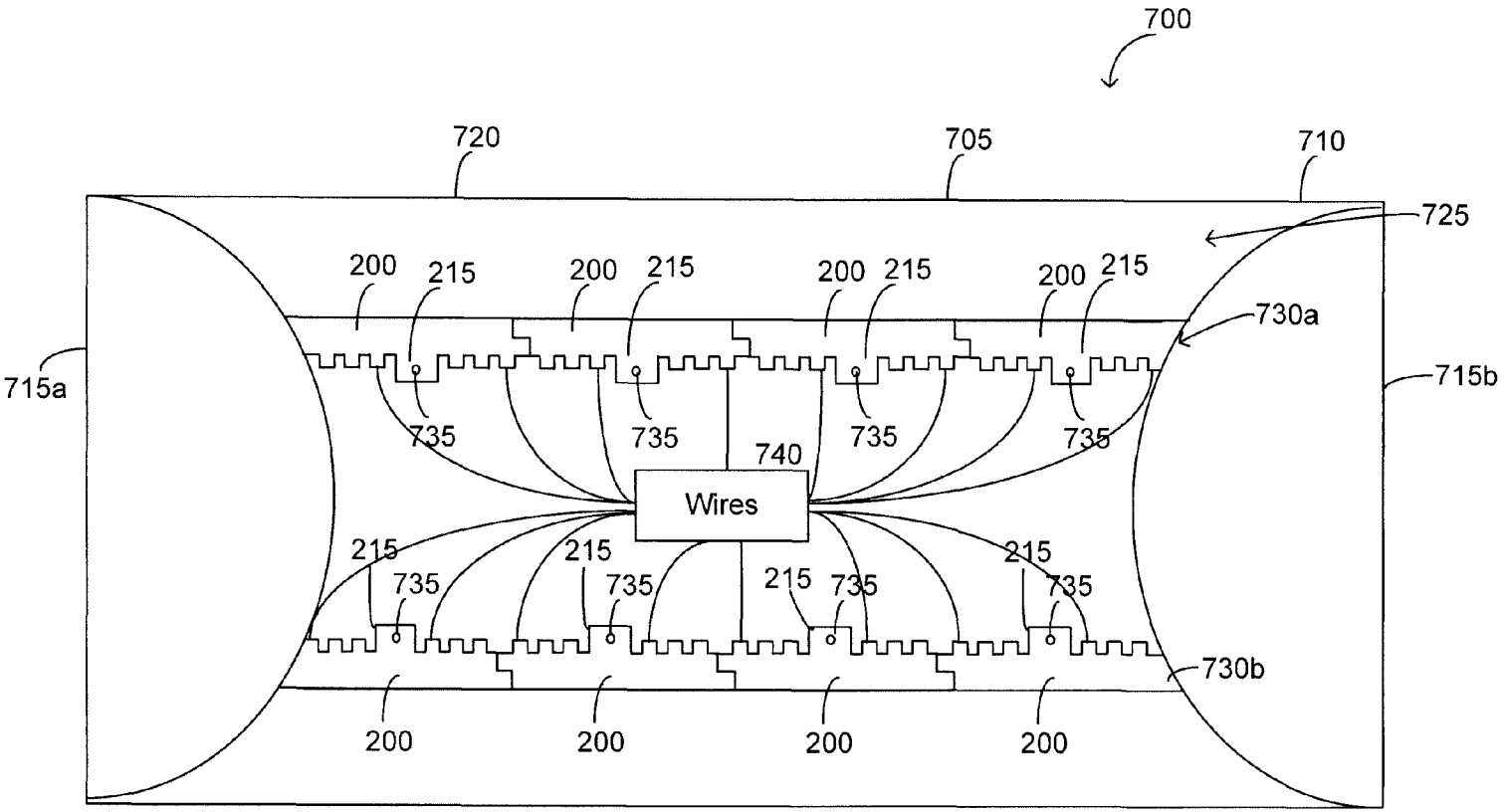
FIG. 7 is an elevational bottom view of a light fixture that includes the linear LED modules depicted in FIG. 2, in accordance with certain exemplary embodiments.

FIG. 7 is an elevational bottom view of a light fixture 700 that includes the linear LED modules 200 depicted in FIG. 2, in accordance with certain exemplary embodiments. The light fixture 700 includes a troffer 705 that includes a frame 710 having side ends 715*a* and 715*b* and a top 720 extending between the side ends 715*a* and 715*b*. In certain exemplary embodiments, each side end 715*a* and 715*b* extends from the top 720 at a substantially orthogonal angle. The side ends 715*a* and 715*b* and top 720 define an interior region 725.

Rows 730*a* and 730*b* of LED modules 200 extend within the interior region 725, substantially between the side ends 715*a* and 715*b*. Each LED module 200 is mounted to the top 720 via solder, braze, welds, glue, epoxy, rivets, clamps, screws, nails, or other fastening means known to a person of ordinary skill in the art having the benefit of the present disclosure. In certain exemplary embodiments, one or more of the LED modules 200 are removably mounted to the top 720 to enable efficient repair, replacement, and/or reconfiguration of the LED module(s) 200. For example, each LED module 200 may be removably mounted to the top 720 via one or more screws 735 extending through protrusions 215 of each LED module 200, substantially as described above. The LED modules 200 are electrically coupled to one another and to a power source (not shown) via one or more wires 740, substantially as described above.

The LED fixture 700 outputs light from the LED modules 200 into an environment associated with the LED fixture 700. Although FIG. 7 depicts a troffer LED fixture 700, a person of ordinary skill in the art having the benefit of the present disclosure will recognize that the LED modules 200 may be used in any other light fixture. For example, the LED modules 200 may be used in light fixtures for indoor and/or outdoor, commercial and/or residential applications.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

What is claimed is:

1. A light fixture, comprising:

a supporting surface; and a plurality of LED modules removably coupled to the supporting surface, each LED module comprising:

a longitudinally extending substrate having a first end and a distal second end;

a plurality of LEDs coupled to a top surface of the substrate;

a notch disposed along the first end of the substrate, said notch extending inward from the first end along a longitudinal axis of the substrate;

a protrusion extending out from the second end of the substrate along the longitudinal axis of the substrate, wherein at least one LED of the plurality of LEDs is coupled to a top surface of the protrusion, wherein adjacent ones of the LED modules interface with one another such that at least a portion of the protrusion of a first adjacent LED module extends into the notch of a second adjacent LED module to provide a substantially continuous, uninterrupted array of LEDs across the LED modules.

2. The light fixture of claim 1, further comprising at least one connector to electrically couple the LED modules, each connector being associated with a pair of adjacent ones of the LED modules, wherein each LED module further comprises an electrical connection disposed along a longitudinally extending side of the substrate between the first end and the second end of the substrate and the electrical connection is configured to electrically couple to one end of the connector.

3. The light fixture of claim 1, wherein the LEDs are arranged in at least one continuous row that extends across the LED modules.

4. The light fixture of claim 1, wherein an alignment pattern of the LEDs continues substantially uninterrupted within and across the LED modules.

5. The light fixture of claim 1, wherein a longitudinal distance between adjacent ones of the LEDs is substantially equal within and across the LED modules.

6. The light fixture of claim 1, wherein the supporting surface provides power to the LED modules.

7. The light fixture of claim 1, wherein each LED module further comprises a plurality of openings in the top surface of the substrate disposed along the longitudinally extending side of the substrate, each opening providing a pathway through the substrate to couple the LED module to the supporting surface of the light fixture.

8. The light fixture of claim 1, wherein each LED module further comprises a plurality of additional notches, each additional notch is disposed along at least one of the longitudinal sides of the substrate and extends into a respective portion of the longitudinal side of the substrate, and each additional notch is configured to receive at least a portion of a protrusion from the adjacent LED module.

9. The light fixture of claim 8, wherein each LED module further comprises a plurality of additional protrusions, each additional protrusion is disposed along at least one of the longitudinal sides of the substrate and extends out from a respective portion of the longitudinal side of the substrate in a direction orthogonal to a longitudinal axis of the substrate, and at least a portion of at least one of the additional protrusions is configured to extend into at least one of the notches of the adjacent LED module.

10. A light emitting diode ("LED") luminaire, comprising:

a first linearly extending LED module comprising:

a first substrate having a first end and a distal second end;

a protrusion extending out from the second end along a longitudinal axis of the first substrate; and a first plurality of LEDs coupled to a top surface of the first substrate, at least one LED of the first plurality of LEDs being coupled to a top surface of the protrusion; and a second linearly extending LED module comprising:

a second substrate having a first end and a distal second end;

a notch disposed on the first end of the second substrate, said notch extending inward from the first end along a longitudinal axis of the second substrate; and a second plurality of LEDs coupled to a top surface of the second substrate, wherein at least a portion of the protrusion on the second end of the first LED module extends into and is disposed within at least a portion of the notch on the first end of the second LED module to provide a substantially continuous, uninterrupted array of LEDs across the first and second LED modules, the array comprising at least a portion of each of the first plurality of LEDs and the second plurality of LEDs.

11. The LED luminaire of claim 10, further comprising a connector electrically coupling the first LED module to the second LED module, the connector being coupled to the first LED module at a first location along a side of the top surface of the first substrate between the first end and the second end of the first substrate and being coupled to the second LED module at a second location along a side of the top surface of the second substrate between the first end and the second end of the second substrate.

12. The LED luminaire of claim 10, wherein the first plurality of LEDs are arranged in at least a first row, and the second plurality of LEDs are arranged in at least a second row, the first and second rows being substantially aligned with one another when the protrusion of the first LED module is at least partially disposed within the notch of the second LED module.

13. The LED luminaire of claim 10, wherein an alignment pattern of the first plurality of LEDs on the first LED module continues substantially uninterrupted across the first LED module and the second LED module when the protrusion of the first LED module is at least partially disposed within the notch of the second LED module.

14. The LED luminaire of claim 10, wherein a longitudinal distance between a first LED of the first plurality of LEDs that is longitudinally disposed closest to the second end of the first LED module and a second LED of the first plurality of LEDs that is longitudinally disposed second-closest to the second end of the first LED module substantially equals a longitudinal distance between the first LED and an LED of the second plurality of LEDs that is longitudinally disposed closest to the first end of the second LED module.

15. The LED luminaire of claim 10, wherein the first plurality of LEDs are offset from a longitudinally extending centerline of the first substrate and the second plurality of LEDs are offset from a longitudinally extending centerline of the second substrate.

16. The LED luminaire of claim 10, further comprising a plurality of openings in the first substrate disposed along a longitudinally extending side of the first substrate, each opening providing a pathway through the first substrate to couple the first linearly extending LED module to a supporting surface.

17. The LED luminaire of claim 16, further comprising a plurality of openings in the second substrate along a longitudinally extending side of the second substrate, each opening providing a pathway through the second substrate to couple the second linearly extending LED module to the supporting surface.

18. A light emitting diode ("LED") luminaire, comprising:

a first linearly extending LED module comprising:

a first substrate having a first end and a distal second end;

a first plurality of LEDs coupled to a top surface of the first substrate;

a protrusion extending out from the second end along a longitudinal axis of the first substrate, at least one LED of the plurality of LEDs being coupled to a top surface of the protrusion; and at least one opening in the top surface of the first substrate and disposed along a longitudinally extending side of the first substrate between the first and second ends, the opening providing a pathway through the first substrate to couple the first linearly extending LED module to a supporting surface;

a second linearly extending LED module comprising:

a second substrate having a first end and a second end;

a second plurality of LEDs coupled to a top surface of the second substrate;

a notch disposed on the first end of the second substrate, said notch extending inward from the first end along a longitudinal axis of the second substrate; and at least one opening in the top surface of the second substrate and disposed along a longitudinally extending side of the second substrate between the first and second ends, the opening providing a pathway through the first substrate to couple the first linearly extending LED module to the supporting surface; and a connector electrically coupling the first LED module to the second LED module, the connector being coupled to each of the first LED module and the second LED module at a location other than at the first and second ends of the LED module, wherein at least a portion of the protrusion of the second end of the first LED module extends into and is disposed within at least a portion of the notch on the first end of the second LED module to provide a substantially continuous, uninterrupted array of LEDs across the first and second LED modules, the array comprising at least a portion of each of the first plurality of LEDs and the second plurality of LEDs.

19. The LED luminaire of claim 18, wherein the first LED module further comprises a first electrical connection disposed along the longitudinally extending side of the top surface of the first substrate between the first end and the second end of the first substrate, and the second LED module further comprises a second electrical connection disposed along the longitudinally extending side of the top surface of the second substrate between the first end and the second end of the second substrate, the connector being coupled to the first electrical connection and the second electrical connection.

* * * * *